US005217853A

United States Patent [19]

Yamada et al.

[11] Patent Number: 5,217,853

[45] Date of Patent: Jun. 8, 1993

[54] METHOD FOR DEVELOPMENT PROCESSING OR SILVER HALIDE PHOTOSENSITIVE MATERIALS

[75] Inventors: Minoru Yamada; Takashi Toyoda, both of Kanagawa, Japan

[73] Assignee: Fuji Photo Film Co., Ltd., Kanagawa, Japan

[21] Appl. No.: 921,607

[22] Filed: Aug. 3, 1992

Related U.S. Application Data

[63] Continuation of Ser. No. 619,546, Nov. 29, 1990, abandoned.

[30] Foreign Application Priority Data

Nov. 29, 1989 [JP] Japan ..... 1-309912

[51] Int. Cl.[5] ..... G03C 5/38

[52] U.S. Cl. ..... 430/419; 430/393; 430/420; 430/451; 430/452; 430/453; 430/455; 430/456; 430/963; 430/966

[58] Field of Search ..... 430/393, 419, 420, 451, 430/452, 453, 455, 456, 963, 966

[56] References Cited

U.S. PATENT DOCUMENTS

| | | | |
|---|---|---|---|
| 19,354 | 10/1934 | Elliott | 430/453 |
| Re. 3,994,729 | 11/1976 | Shibaoka | 430/420 |
| 4,672,025 | 6/1987 | Yamada et al. | 430/966 |
| 4,826,757 | 5/1989 | Yamada et al. | 430/966 |
| 4,861,702 | 8/1989 | Suzuki et al. | 430/966 |
| 4,906,553 | 3/1990 | Ikegawa et al. | 430/963 |
| 4,917,993 | 4/1990 | Mukunoki et al. | 430/966 |
| 4,994,355 | 2/1991 | Dickerson et al. | 430/963 |

FOREIGN PATENT DOCUMENTS

| | | |
|---|---|---|
| 1197729 | 12/1959 | France . |
| 1152428 | 5/1969 | United Kingdom . |

OTHER PUBLICATIONS

Patent Abstract of Japan (P-771) Oct. 17, 1988, & JP-A-63 131139 (Fuji Photo Film Co., Ltd. Jun. 3, 1988.

Research Disclosure No. 154, Feb. 1977, Havant GB, pp. 5-6; J. R. Edmundson: "Reducing the Evolution of Sulphur Dioxide from Photographic Fixing Baths", p. 5, col. 2, Method 1.

Communication dated Feb. 12, 1991/European Search Report dated Jan. 25, 1991.

*Primary Examiner*—Hoa Van Le

*Attorney, Agent, or Firm*—Sughrue, Mion, Zinn, Macpeak & Seas

[57] ABSTRACT

A method for development processing of a silver halide photosensitive material using an automatic processor including at least the functions of development, fixing, washing and drying is disclosed, comprising using an alkaline developer containing a dialdehyde film hardening agent and carrying out the processing under conditions such that the running equilibrium pH of the fixer is at least 4.6.

12 Claims, No Drawings

METHOD FOR DEVELOPMENT PROCESSING OR SILVER HALIDE PHOTOSENSITIVE MATERIALS

This is a continuation of application Ser. No. 07/619,546 filed Nov. 29, 1990, now abandoned.

FIELD OF THE INVENTION

This invention concerns a method for development processing of silver halide photosensitive materials, and in particular it concerns a method for development processing of exposed silver halide photosensitive materials using an automatic developing machine which includes at least the functions of developing, fixing, washing and drying where there is no fixer odor, where there is little residual thiosulfate, and where there is little residual coloration.

BACKGROUND OF THE INVENTION

Recently, automatic developing machines (referred to hereinafter as automatic processors) have become widely used for development processing of silver halide photosensitive materials. There are various types of automatic processor, but this invention is concerned with automatic processors which include at least the functions of development, fixing, washing and drying.

The latest trend is for rapid development processing of photosensitive materials. For example, there is an increasing necessity for rapid processing of graphic arts sensitive materials, X-ray sensitive materials, scanner sensitive materials and sensitive materials which are used for recording CRT images. Moreover, demands have arisen for a reduction in the volume of waste processing liquids (developer and fixer) which have been used in development processing from the standpoint of environmental protection. It is necessary to reduce the replenishment rates which are used when processing photosensitive materials in order to reduce the amounts of these waste processing liquids.

However, the fixing properties in the fixing process are adversely affected as the processing speed increases and as the rate of replenishment of the fixer is reduced. Moreover, when larger amounts of thiosulfate from the processing bath remain in the sensitive material, the storage properties of the image tend to be adversely affected. Further, if sensitizing dyes which have been added to the sensitive material are not washed out satisfactorily, the sensitive material has an unwanted residual coloration after processing.

Combinations of developers in which aldehyde film hardening agents are used and fixers in which aluminum salt film hardening agents are used are employed for development processing of normal X-ray photosensitive materials (for example, see JP-A-1-158439). (The term "JP-A" as used herein signifies an "unexamined Japanese patent publication".) Aluminum salt film hardening .agents have a stronger film hardening effect at lower pH levels and so in the past the fixer and fixer replenisher pH values have been set in such a way that the pH of the fixer is maintained at from 4.0 to 4.5, and the replenishment rate has also been controlled.

However, there is a strong odor due to sulfur dioxide gas and acetic acid gas with fixers where pH is low, and there is considerable corrosion of the automatic processor and peripheral equipment. This is not consistent with the approach of using an automatic processor in an ordinary room and not a specially designed room.

SUMMARY OF THE INVENTION

An object of this invention is to provide a method for development processing of silver halide photosensitive materials using an automatic processor including at least the functions of development, fixing, washing and drying where there is no fixer odor, where the amount of residual thiosulfate is small, where the storage properties after processing are improved, and where there is little residual coloration.

This object of the invention has been achieved by a method for development processing of silver halide photosensitive materials using an automatic processor including at least the functions of development, fixing, washing and drying, which comprises using an alkaline developer containing a dialdehyde film hardening agent and carrying out the processing under conditions such that the running equilibrium pH of the fixer is at least 4.6.

DETAILED DESCRIPTION OF THE INVENTION

The running equilibrium pH value of the fixer as used in the specification of this invention is the pH of the liquid in the fixer tank of the automatic processor when replenishment has been carried out in an amount of about twice the volume of the fixer tank. In this invention, the system is controlled in such a way that the running equilibrium pH of the fixer is at least 4.6, preferably from 4.6 to 5, and most desirably from 4.7 to 4.9. The fixer odor is greatly reduced in this way and there is also little corrosion of the operating environment and equipment.

The pH of the fixer replenisher must be set at a level below the running equilibrium pH value in order to compensate for carry-over of (alkaline) developer into the fixer tank. However, this pH must not be too low and a pH in the range from 4.2 to 4.7 is generally appropriate. Hence, by selecting an appropriate pH within this range it is possible to provide a single reagent fixer replenisher kit with no need for any separation of the fixer replenishment kit into a part which contains principally the thiosulfate and a part which contains principally the aluminum salt film hardening agent.

The use of a dialdehyde film hardening agent in the developer is essential in this invention. The reason for this is unclear, but the amount of residual thiosulfate in the photosensitive material can be reduced and residual coloration can be reduced by using such a film hardening agent and by maintaining the running equilibrium pH value of the fixer within the range specified for this invention.

The effect of this invention is especially pronounced with rapid processing. The use of the method of this invention is especially advantageous when processing is carried out in such a way that the time from development to completion of drying is within 90 seconds, and preferably within 70 seconds.

Furthermore, the effect of the invention is more pronounced where the fixer replenishment rate is low. For example, the use of the method of this invention is advantageous where the fixer replenishment rate is, 0.8 liter or less, especially 0.5 liter or less, per square meter of photosensitive material.

When the development processing of this invention is employed, the fixer film hardening is weak and so there is an increased drying load for drying the photosensitive material and it is therefore desirable that the drying capacity of the automatic processor should be high. For example, use can be made of the far infrared heaters as disclosed in JP-A-1-234849, methods in which microwaves are used, drying methods as disclosed in JP-A-1-123233, JP-A-1-123236, JP-A-1-131563, JP-A-1-131564 and JP-A-1-131565, and the method for use of a drying zone with a roller whose surface is a porous elastic material as disclosed in JP-A-1-72158 can be employed to absorb this increase in drying load.

No particular limitation is imposed upon the developing agent used in the developer which is used in this invention, but the use of dihydroxybenzenes is desirable, and combinations of dihydroxybenzenes and 1-phenyl-3-pyrazolidones and combinations of dihydroxybenzenes and p-aminophenols are especially preferred.

Hydroquinone, chlorohydroquinone, isopropylhydroquinone, methylhydroquinone, 2,3-dichlorohydroquinone, 2,5-dichlorohydroquinone, 2,3-dibromohydroquinone and 2,5-dimethylhydroquinone are examples of dihydroxybenzene developing agents which can be used in this invention, and hydroquinone is especially preferred.

N-Methyl-p-aminophenol, p-aminophenol, N-(β-hydroxyethyl)-p-aminophenol, N-(4-hydroxyphenyl)glycine, 2-methyl-2-p-aminophenol and p-benzylaminophenol are examples of p-aminophenol developing agents which can be used in this invention. Of these, N-methyl-p-aminophenol is preferred.

1-Phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone and 1-p-tolyl-4-methyl-4-hydroxymethyl-3-pyrazolidone are examples of 1-phenyl-3-pyrazolidone developing agents which can be used in this invention.

The developing agent is generally used in a preferred amount of from 0.01 mol/liter to 1.2 mol/liter.

Sodium sulfite, potassium sulfite, lithium sulfite, ammonium sulfite, sodium bisulfite or potassium metabisulfite, for example, can be used as the sulfite preservative in this invention. The sulfite is used at a concentration of at least 0.2 mol/liter, and preferably of at least 0.4 mol/liter, while the preferred upper limit of the concentration is 2.5 mol/liter.

The pH of the developer used in this invention is within the range from 9 to 13, and preferably within the range from 9.5 to 12.

Water-soluble inorganic alkali metal salts (for example, sodium hydroxide, sodium carbonate, potassium carbonate, sodium triphosphate, potassium triphosphate) can be used as the alkali which is used for setting the pH.

The borates disclosed in JP-A-62-186259, the sugars (for example, saccharose) disclosed in JP-A-60-93433, oximes (for example, acetoxime), phenols (for example, 5-sulfosalicylic acid), triphosphates (for example, the sodium and potassium salts), and carbonates, for example, can be used as buffers in the developers which are used in this invention.

The use of dialdehydes or bisulfite additions compounds thereof is preferred for the dialdehyde film hardening agent which is used in this invention. Specific examples of suitable compounds include glutaraldehyde, α-methylglutaraldehyde, β-methylglutaraldehyde, maleic dialdehyde, succinic dialdehyde, methoxysuccinic dialdehyde, methylsuccinic dialdehyde, α-methoxy-β-butoxyglutaraldehyde, α-n-butoxysuccinic dialdehyde, α,α-dimethoxysuccinic dialdehyde, β-isopropylsuccinic dialdehyde, α,α-diethylsuccinic dialdehyde, butylmaleic dialdehyde and the bisulfite addition compounds of these dialdehydes.

The amount of dialdehyde film hardening agent present in the developer is preferably from 1 to 95 grams, and more preferably from 2 to 10 grams, per liter of developer.

Development inhibitors such as sodium bromide and potassium bromide, organic solvents such as ethylene glycol, diethylene glycol, triethylene glycol and dimethylformamide, and anti-foggants including, for example, mercapto compounds such as 1-phenyl-5-mercaptotetrazole and 2-mercaptobenzimidazole, indazole compounds such as 5-nitroindazole and benzotriazole compounds such as 5-methylbenzotriazole, may be employed as additives which can be used in addition to the components described above, and the development accelerators disclosed in *Research Disclosure,* volume 176, No. 17643, section XXI (December 1978), and, if desired, color toners, surfactants, anti-foaming agents, and hard water softening agents, for example, can also be employed.

Anti-silver staining agents, for example the compounds disclosed in JP-A-56-24347, can be used in the developer in development processing of this invention.

Amine compounds such as the alkanolamines disclosed in JP-A-56-106244 can also be used in the developer in this invention.

The additives disclosed, for example, in L.F.A. Mason, *Photographic Processing Chemistry,* pages 226–229 (published by Focal Press, 1966), and in U.S. Pat. Nos. 2,193,015 and 2,592,362, and JP-A-48-64933 can also be used.

The fixer is an aqueous solution which contains thiosulfate as a fixing agent. The fixing agent is sodium thiosulfate or ammonium thiosulfate, for example, but the use of ammonium thiosulfate is especially preferred from the viewpoint of the fixing rate. The amount of fixing agent used can be varied appropriately, but in general an amount of from about 0.1 to about 6 mol/liter is used.

The degree of swelling of the photosensitive material should be small (100% to 250%), as described hereinafter, and the process film hardening should be low in order to achieve rapid processing. In this invention, the running equilibrium pH of the fixer is at least 4.6 and so the film hardening action is low even when a film hardening agent is present in the fixer and this is appropriate for rapid processing. Moreover, an advantage is also achieved in that no offensive odor is produced by the fixer. Furthermore, it is possible to increase the pH of the fixer replenisher concentrate (pH 4.6 or above) by setting a higher running equilibrium pH in this way. As a result of this, the fixer replenisher concentrate can be provided as a single reagent. This is an advantage in that the replenisher can be prepared by simply diluting the concentrate with water when the replenisher concentrate is a single reagent.

Water-soluble aluminum salts which act as film hardening agents may be present in the fixer, and examples of such salts include aluminum chloride, aluminum sulfate and potassium alum. The preferred amount of hardening agent is from 0.01 to 0.2 mol/liter, and the amount is more preferably from 0.03 to 0.08 mol/liter.

Tartaric acid, citric acid, gluconic acid or derivatives of these acids can be used individually or as combinations of two or more thereof in the fixer. These compounds are effective when used in amounts of not less than 0.005 mol per liter of fixer, and they are especially effective when used in amounts of from 0.01 to 0.03 mol per liter of fixer.

Preservatives (for example, sulfite, bisulfite), pH buffers (for example, acetic acid, boric acid), pH adjusting agents (for example, sulfuric acid) and chelating agents (described hereinafter) can be employed, as desired, in the fixer. Compounds which accelerate the washing out of sensitizing dyes from the photosensitive material can also be present in the fixer. Compounds which function in this way include those disclosed in EP 341,637, JP-A-64-4739 and JP-A-64-15734. These compounds exhibit an especially effective action when the fixer replenishment rate is particularly low (when the replenishment rate is low the amount of iodide ion in the fixer increases, and hence when the concentration of iodide ion in the running equilibrium bath is 0.6 mmol/liter or above).

The fixer replenisher preferably contains the same components as the above-described fixer, but some of the components may be changed and the proportions of the components may also be changed. The fixer replenisher is preferably supplied to the user in the form of a concentrate and diluted for use. The concentrate can be prepared as a single reagent, or in the form of two or more reagents which are mixed together and diluted at the time of use. In the latter case, handling is easier if the containers which house the respective parts are combined as one.

The replenishment rate of the fixer replenisher is preferably not more than 0.8 liter, especially not more than 0.5 liter, per square meter of photosensitive material. More preferably, the replenishment rate is not more than 0.4 liter, and most desirably the replenishment rate is not more than 0.3 liter, per square meter of photosensitive material.

The use of high concentrations of pH buffers (for example, acetic acid, boric acid) is preferred where the running equilibrium pH of the fixer is higher than normal in accordance with this invention. The pH buffer concentration in the fixer is generally on the order of 0.3 mol/liter, but in this invention it is at least 0.5 mol/liter, and more preferably is from 0.5 to 1 mol/liter. Furthermore, a rinse bath or an acidic bath may be provided between development and fixing in order to minimize the effect of developer carryover.

With the method of development processing of this invention, the processing can be carried out with washing water or a stabilizer with a replenishment rate of not more than 3 liters per square meter of photosensitive material (including zero, which is to say for residual washing water) after the development and fixing processes. That is to say, not only is it possible to economize on water in the process but it is also possible to eliminate automatic processor piping.

Methods of reducing the replenishment rate of the washing water include the use of the well known multistage counter flow systems (for example, with two or three stages) and here the fixed photosensitive material is brought into contact successively with water which is cleaner in each stage and which is not contaminated with fixer, thus efficient washing can be achieved.

A means of preventing the growth of fungi in the water washing water or stabilizer is preferred in the above-described systems in which economies are made with washing water and in piping free water washing treatments.

Examples of means of preventing the growth of fungi include an ultraviolet irradiation method disclosed in JP-A-60-263939, a method in which magnetic fields are used as disclosed in JP-A-60-263940, methods involving the introduction of ozone as disclosed in *Ozone Using Processing Techniques,* edited by I. Somiya, (published by Kogai Taisaku Gijutsu Doyukai, 1989), a method in which the water is purified using an ion exchange resin as disclosed in JP-A-61-131632, and methods in which biocides are used as disclosed in JP-A-62-115154, JP-A-62-153952, JP-A-62-220951 and JP-A-62-209532.

Moreover, biocides, fungicides, surfactants, etc., as disclosed, for example, in L. E. West, "Water Quality Criteria", *Photo. Sci. & Eng.,* Vol. 9, No. 6 (1965), M. W. Beach, "Microbiological Growths in Motion Picture Processing", *SMPTE Journal,* Vol. 85 (1976), R. O. Deegan, "Photo-processing Wash Water Biocides", *J. Imaging Tech.,* Vol. 10, No. 6 (1984), and in JP-A-57-8542, JP-A-57-58143, JP-A-58-105145, JP-A-57-132146, JP-A-58-18631, JP-A-57-97530 and JP-A-57-157244 can be used in combination as desired.

Moreover, the isothiazoline compounds disclosed in R. T. Kreiman, *J. Image. Tech.,* Vol. 10, No. 6, page 242 (1984), the isothiazoline compounds disclosed in *Research Disclosure,* Vol. 205, No. 20526 (May 1981), the isothiazoline compounds disclosed in *Research Disclosure,* Vol. 228, No. 22845 (April 1983), the compounds disclosed in JP-A-62-209532 and the silver ion releasing agents disclosed in JP-A-2-269339 can be used in combination as microbiocides in the water washing bath or stabilizer bath.

Compounds such as those disclosed in Horiguchi, *The Chemistry of Biocides and Fungicides,* published by Sankyo Shuppan (1982), and in *Biocide and Fungicide Technology Handbook,* edited by the Japanese Biocide and Fungicide Association and published by Hakuhodo (1986) can also be included.

The use of a squeeze roller washing tank as disclosed in JP-A-63-18350 is preferred when washing with a small amount of washing water in the method of this invention. Furthermore, the use of a water washing process such as that disclosed in JP-A-63-143548 is also desirable.

Moreover, in the method of this invention some or all of the overflow from the water wash or the stabilizing bath which is produced by replenishing the water or stabilizing bath with water which has been subjected to a antifungal treatment can be used for the processing liquid which has a fixing capacity in an earlier processing stage as disclosed in JP-A-60-235133.

When the silver halide photosensitive material of this invention is processed in an automatic processor which includes at least development, fixing, water washing (or stabilization) and drying as described above, completion of the processes from development to drying within 90 seconds, i.e., the so-called dry to dry time which is the time from the start of the immersion at the leading end of the photosensitive material into the developer until the same leading end of the photosensitive material emerges from the drying zone after passing through the fixing and washing processes, of within 90 seconds is preferred. A dry to dry time within 70 seconds is more preferred. A dry to dry time within 60 seconds is most preferred.

In this invention, the "development processing time" or "development time" signifies the time from the instant at which the leading end of the photosensitive material which is to be processed as described above is immersed in the development tank of the automatic processor until the same leading end is immersed in the following fixer; the "fixing time" signifies the time from the instant at which the leading end of the photosensitive material is immersed in the fixer tank until the same leading end is immersed in the next water washing tank (stabilizer bath); and the "water washing time" is the time for which the photosensitive material is immersed in the water washing tank.

Furthermore, the "drying time" signifies the time during which the photosensitive material is within the drying zone, this being a zone in which the material is blown with a hot current of air, normally at a temperature of from 35° C. to 100° C., and preferably of from 40° C. to 80° C., which is present inside the automatic processor.

A development time within 20 seconds, and preferably within 15 seconds, can be used to achieve rapid processing with a dry to dry time as described above of within 70 seconds, and the development temperature is preferably between 25° C. and 50° C., and more preferably between 30° C. and 40° C.

According to this invention, the fixing temperature and time are preferably from about 20° C. to about 50° C. and from 6 to 20 seconds, and more preferably from 30° C. to 40° C. and from 6 to 15 seconds, respectively. Adequate fixing can be achieved within this range, and the sensitizing dyes can be washed out to such an extent that there is no residual coloration.

The water washing or stabilization temperature and time are preferably from 0° C. to 50° C. and from 6 to 20 seconds, and more preferably from 15° C. to 40° C. and from 6 to 15 seconds, respectively.

According to the method of this invention, the developed, fixed and washed (or stabilized) photographic material can be dried using a device which removes the washing water, which is to say using a squeeze roller. Drying is carried out at a temperature of from about 40° C. to about 100° C. and the drying time can be changed appropriately depending on the ambient conditions, but it-is generally from about 5 to about 30 seconds, and drying at a temperature of from 40° C. to 80° C. for a period of from about-5-seconds to about 20 seconds is preferred.

The use of a rubber roller for the roller at the development tank exit as disclosed in JP-A-63-151943 is preferred to prevent uneven development in rapid processing, and the use of a discharge flow rate of 10 m/min or more for agitating the developer in the developer tank as disclosed in JP-A-63-151944 and stronger agitation during development processing than during stand-by at least as disclosed in JP-A-63-264758 are more preferred when development processing is carried out with a dry to dry time of not more than 70 seconds and a sensitive material/processing system of this invention. Moreover, use of a roller in the fixer tank as a counter roller is more preferred for accelerating the fixing rate in particular for achieving rapid processing of the type to which this invention relates. The number of rollers can be reduced using a counter roller and the size of the processing tank can be reduced. That is to say, the automatic processor can be made more compact.

No particular limitation is imposed upon the photographic photosensitive material used in the method for development processing of the photosensitive materials of this invention. Generally, black-and-white photosensitive materials are used mainly, but the method can also be employed with color photosensitive materials. In particular, laser printer photographic materials for medical images, printing scanner photosensitive materials, medical direct camera X-ray sensitive materials, medical indirect X-ray sensitive materials, and CRT image recording sensitive materials, for example, can be used. This invention is especially suitable for processing of black-and-white photosensitive materials to produce a silver image.

Methods such as those indicated below, or combinations of two or more of these methods can be used to manufacture a photosensitive material which is suitable for rapid processing in accordance with this invention.

(1) The use of silver halides which contain a small amount of iodide or which are iodide free. That is to say, the use of silver chloride, silver bromide, silver chlorobromide, silver iodobromide and silver chloroiodobromide where the silver iodide content is from 0 to 5 mol. %.

(2) The inclusion of water-soluble iridium salts in the silver halide emulsion.

(3) Minimizing the coated silver weight in the silver halide emulsion layer, for example, using a coated silver weight on one surface of from 1 to 3.5 $g/m^2$, and preferably of from 1 to 3 $g/m^2$.

(4) Minimizing the average grain size of the silver halide in the emulsion, for example, using an average grain size of not more than 1.0$\mu$, and preferably of not more than 0.7$\mu$.

(5) Using tabular grains, for example, tabular grains which have an aspect ratio of at least 4, and preferably of at least 5, for the silver halide grains in the emulsion.

(6) Arranging for the degree of swelling of the silver halide photosensitive material to be not more than 250%.

The silver halide grains in the photographic emulsion may be regular grains which have a regular crystalline form such as a cubic, octahedral or tetradecahedral form, or they may have an irregular crystalline form such as a spherical form, for example, or they may have crystal defects such as twinned crystal planes, or they may be tabular grains or grains which are a composite of these forms.

The tabular grain aspect ratio is the ratio of the average value of the diameters of the circles which have the same area as the projected area of the individual tabular grains and the average value of the grain thickness of the individual tabular grains. In this invention, preferred tabular grains are those which have a form of aspect ratio at least 4 but less than 20, and more preferably which have an aspect ratio of at least 5 and less than 10. Moreover, the grain thickness is preferably not more than 0.3$\mu$, and more preferably not more than 0.2$\mu$.

Tabular grains preferably account for at least 80 wt. %, and more preferably at least 90 wt. %, of all the grains.

The emulsions may be monodisperse emulsions in which the silver halide grain size distribution is narrow, or may be polydisperse emulsions in which the silver halide grains size distribution is wide.

Silver halide photographic emulsions which can be used in this invention can be produced using known methods, and the methods disclosed, for example, in *Research Disclosure,* No. 17643 (December 1978), pages 22–23, "Emulsion Preparation and Types", and ibid, No. 18716 (November 1979), page 648 are suitable.

Photographic emulsions which can be used in this invention can be prepared using the methods described, for example, in P. Glafkides, *Chimie et Physique Photographique,* published by Paul Montel, 1967, in G. F. Duffin, *Photographic Emulsion Chemistry,* published by Focal Press, 1966, and in V. L. Zelikmann et al., *Making and Coating Photographic Emulsions,* published by Focal Press, 1964.

Furthermore, ammonia, potassium thiocyanate, ammonium thiocyanate, thioether compounds (for example, those disclosed in U.S. Pat. Nos. 3,271,157, 3,574,628, 3,704,130, 4,297,439 and 4,276,374), thione compounds (for example, those disclosed in JP-A-53-144319, JP-A-53-82408 and JP-A-55-77737), and amine compounds (for example, those disclosed in JP-A-54-100717) can be used as silver halide solvents to control grain growth during the formation of the silver halide grains which can be used in this invention.

Water-soluble rhodium salts- and water-soluble iridium salts, as described earlier, can be used in this invention.

Single sided mixing methods, simultaneous mixing methods and combinations of these methods can all be used for reaction of the soluble silver salt and the soluble halogen salt in this invention.

Methods in which the grains are formed in the presence of an excess of silver ion (the so-called reverse mixing methods) can also be used. The method in which the pAg in the liquid phase in which the silver halide grains are being formed is held constant, i.e., the so-called controlled double jet method, can be used as one type of simultaneous mixing method. This method produces silver halide emulsions in which the crystal form is regular and in which the grain size is substantially uniform.

The silver halide emulsions used in the method of this invention preferably are subjected to chemical sensitization.

Conventional sulfur sensitization methods, reduction sensitization methods, precious metal sensitization methods and combinations of these methods can be used for chemical sensitization.

Moreover, specific examples of suitable chemical sensitizing agents include sulfur sensitizing agents such as allyl thiocarbamide, thiourea, thiosulfate, thioethers and cystine; precious metal sensitizing agents such as potassium chloroaurate, aurous thiosulfate and potassium chloropalladate; and reduction sensitizing agents such as tin chloride, phenylhydrazine and reductone.

The silver halide emulsions used in this invention can be spectrally sensitized, as required, using known spectral sensitizing dyes. Spectral sensitizing dyes which can be used include cyanine dyes, merocyanine dyes, rhodacyanine dyes, styryl dyes, hemicyanine dyes, oxonol dyes, benzylidine dyes and holopolar dyes, as described, for example, in F. M. Hamer, *Heterocyclic Compounds—The Cyanine Dyes and Related Compounds,* published by John Wiley & Sons, 1964, and in D. M. Sturmar, *Heterocyclic Compounds—Special Topics in Heterocyclic Chemistry,* published by John Wiley, 1977. The use of cyanine dyes and merocyanine dyes is especially preferred.

The cyanine dyes and merocyanine dyes represented by the general formulae disclosed, for example, in JP-A-60-133442, JP-A-61-75339, JP-A-62-6251, JP-A-59-212827, JP-A-50-122928 and JP-A-59-180553 are examples of sensitizing dyes which are used preferably in this invention. Specific examples include sensitizing dyes which spectrally sensitize silver halides to the blue, green, red and infrared regions of the spectrum, as described, for example, on pages 8–11 of JP-A-60-133442, pages 5–7 =and- pages 24–25 of JP-A-61-75339, pages 10–15 of JP-A-62-6251, pages 5–7 of JP-A-59-212827, pages 7–9 of JP-A-50-122928 and pages 7–18 of JP-A-59-180553.

These sensitizing dyes may be used individually or they may be used in combination. Combinations of sensitizing dyes are frequently used to achieve supersensitization. Substances which exhibit supersensitization, which are dyes themselves but have no spectral sensitizing action or substances which essentially do not absorb visible light, can be present in the emulsion together with the sensitizing dyes. For example, substituted aminostilbene compounds with a nitrogen containing heterocyclic group (for example, those disclosed in U.S. Pat. Nos. 2,933,390 and 3,635,721), aromatic organic acid/formaldehyde condensates (for example, those disclosed in U.S. Pat. No. 3,743,510), and cadmium salts and azaindene compounds, for example, may be present. The combinations disclosed in U.S. Pat. Nos. 3,615,613, 3,615,641, 3,617,295 and 3,635,721 are especially useful.

The above-described sensitizing dyes are present in the silver halide photographic emulsion layer in a proportion of from $5\times10^{-7}$ to $5\times10^{-2}$ mol, preferably of from $1\times10^{-6}$ to $1\times10^{-3}$ mol, and more preferably of from $2\times10^{-6}$ to $5\times10^{-4}$ mol, per mol of silver halide.

The above-described sensitizing dyes can be dispersed directly in the emulsion layer. Furthermore, these dyes may be dissolved initially in a suitable solvent, such as methyl alcohol, ethyl alcohol, methyl Cellosolve, acetone, water, pyridine or mixtures of these solvents, for example, and then added to the emulsion in the form of a solution. Furthermore, ultrasonics can be used for dissolution purposes. Furthermore, methods in which the dye is dissolved in a volatile organic solvent, the solution produced is dispersed in a hydrophilic colloid and the dispersion is added to the emulsion as disclosed, for example, in U.S. Pat. No. 3,469,987; methods in which a water-insoluble dye is dispersed in a water-soluble solvent without dissolution and the dispersion is added to the emulsion as disclosed in JP-B-46-24185; methods in which a water-insoluble dye is pulverized and dispersed mechanically in an aqueous solvent and the dispersion is added to the emulsion as disclosed in JP-B-61-45217; methods in which the dye is dissolved in a surfactant and the solution is added to the emulsion as disclosed in U.S. Pat. No. 3,822,135; methods in which dissolution is achieved using a red shifting compound and the solution is added to the emulsion as disclosed in JP-A-51-74624; and methods in which the dye is dissolved in an acid which is essentially water free and the solution is added to the emulsion as disclosed in JP-A-50-80826 can be used as methods for the addition of the above-described dyes. (The term "JP-B" as used herein signifies an "examined Japanese patent publication".) The methods disclosed, for example, in U.S. Pat. Nos. 2,912,343, 3,342,605, 2,996,287 and 3,429,835 can also be used for addition to the emulsion. Furthermore, the above-described sensitizing dyes may be dispersed uniformly in a silver halide emulsion before coating on an appropriate support, but of course they can also be dispersed during the preparation of the silver halide emulsion is being prepared.

The above-described sensitizing dyes can be used in combination with other sensitizing dyes. For example, the sensitizing disclosed in U.S. Pat. Nos. 3,703,377, 2,688,545, 3,397,060, 3,615,635 and 3,628,964, British Patents 1,242,588 and 1,293,862, JP-B-43-4936, JP-B-44-14030, JP-B-43-10773, U.S. Pat. No. 3,416,927, JP-B-43-4930, and U.S. Pat. Nos. 2,615,613, 3,615,632, 3,617,295 and 3,635,721 can be used.

The degree of swelling of the silver halide photosensitive material is preferably not more than 250% for rapid processing of silver halide photosensitive materials of this invention.

If the degree of swelling is too low, the rates of development, fixing and water washing are reduced and so reduction of the degree of swelling further than required is undesirable.

The degree of swelling is preferably not more than 250% but is at least 100%, and more preferably it is not more than 250% and is at least 150%.

The degree of swelling can be controlled to not more than 250% easily by those skilled in the art by increasing the amount of film hardening .agent which is used in the photosensitive material, for example.

The degree of swelling can be determined by (a) incubating the photographic material for 3 days under conditions of 38° C. and 50% relative humidity, (b) measuring the thickness of the hydrophilic colloid layers, (c) immersing the photographic material in distilled water at 21° C. for 3 minutes and (d) comparing the thickness of the swollen hydrophilic colloid film thickness with that measured in process (b), and by calculating the percentage change in the layer thickness.

Examples of film hardening agents which can be used in this invention include active halogen compounds disclosed, for example, in U.S. Pat. No. 3,288,775, compounds which have reactive unsaturated ethylenic unsaturated groups disclosed, for example, in U.S. Pat. No. 3,635,718, epoxy compounds disclosed, for example, in U.S. Pat. No. 3,091,537 and organic compounds such as epoxy compounds and halocarboxyaldehydes such as mucochloric acid, for example. Of these, vinylsulfone film hardening agents are preferred. Moreover, macromolecular film hardening agents can also be used advantageously.

Polymers which have an active vinyl group or a precursor group thereof are preferred as macromolecular film hardening agents. Of these polymers which have active vinyl groups or precursor groups thereof bonded to the main polymer chain with long spacers as disclosed in JP-A-56-142524 are especially preferred. The amount of these film hardening agents used to achieve the above-described degree of swelling differs depending on the type of film hardening agent and the type of gelatin used.

The inclusion of organic materials which are washed out during development processing operation in the emulsion layer and/or other hydrophilic colloid layers is desirable for rapid processing of this invention. The material which is washed out is preferably, in the case of gelatin, a type of gelatin which does not undergo a gelatin crosslinking reaction with the film hardening agent, for example, an acetylated gelatin or phthalated gelatin, and those which have a low molecular weight are preferred. On the other hand, polyacrylamide as disclosed in U.S. Pat. No. 3,271,158 and/or hydrophilic polymers such as poly(vinyl alcohol) and polyvinylpyrrolidone, for example, can be used as macromolecular substances other than gelatin, and sugars such as dextran, sacharaose and pullulan, for example, are also effective. Of these, polyacrylamide and dextran are preferred, and polyacrylamide is the most preferred material. The average molecular weight of these materials is preferably not more than 20,000, and more preferably not more than 10,000. The amount dissolving out during processing is effectively at least 10% but not more than 50%, and more preferably at least 15% but not more than 30%, of the total amount of material coated other than the silver halide grains.

Hydrazine derivatives can be used in this invention, and high contrast photographic characteristics can be obtained.

Suitable hydrazine derivatives which can be used include those disclosed in *Research Disclosure* No. 23516 (November 1983, page 346) and the literatures cited therein, and those disclosed in U.S. Pat. Nos. 4,080,207, 4,269,929, 4,276,364, 4,278,748, 4,385,108, 4,459,347, 4,560,638 and 4,478,928, British Patent 2,011,391B and JP-A-60-179734. The amount of hydrazine derivative used is preferably from $1\times10^{-6}$ to $5\times10^{-2}$ mol, and more preferably within the range from $1\times10^{-5}$ to $2\times10^{-2}$ mol, per mol of silver halide.

Furthermore, the amino compounds disclosed in U.S. Pat. No. 4,269,929 may be used as contrast enhancing accelerators in the developer which is used.

The invention is described in greater detail below by means of illustrative examples. Unless otherwise indicated, all parts, percents, ratios and the like are by weight.

EXAMPLE 1

Preparation of the Emulsion

Potassium bromide (5 grams), 25.6 grams of gelatin and 2.5 ml of a 5% aqueous solution of a thioether, $OH(CH_2)_2S—(CH_2)_2S(CH_2)_2OH$, were added to 1 liter of water and an aqueous solution which contained 8.33 grams of silver nitrate and an aqueous solution which contained 5.94 grams of potassium bromide and 0.726 gram of potassium iodide were added over a period of 45 seconds using the double jet method while maintaining the solution temperature at 66° C. and stirring the mixture. Next, 2.9 grams of potassium bromide was added and then an aqueous solution which contained 8.33 grams of silver nitrate was added over a period of 24 minutes, after which 0.1 mg of a thiourea dioxide of the structure shown below was added.

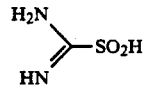

Subsequently, 20 ml of a 25% ammonia solution and 10 ml of 50% ammonium nitrate were added and, after physically ripening the mixture for 20 minutes, the mixture was neutralized by the addition of 240 ml of 1N sulfuric acid. Next, an aqueous solution of 153.34 grams of silver nitrate and an aqueous solution containing potassium bromide and potassium iodide were added over a period of 40 minutes using the controlled double jet method while maintaining the pAg at 8.2. The flow rate was accelerated such that the flow rate at the end of the addition was nine times the flow rate at the start of the addition. After the addition had been completed, 15 ml of a 2N potassium thiocyanate solution was added and 45 ml of a 1% aqueous potassium iodide solution was added over a period of 30 seconds. Subsequently, the temperature was reduced to 35° C. and, after removing the soluble salts by sedimentation, the temperature was increased to 40° C. and 76 grams of gelatin, 76 mg of Proxel GXL and 760 mg of phenoxyethanol were added and the pH and pAg values of the emulsion were adjusted to 6.50 and 8.20, respectively using sodium hydroxide and potassium bromide. The temperature was then increased to 56° C., after which 186 mg of 4-hydroxy-6-methyl-1,3,3a,7-tetraazaindene was added and, after 10 minutes, 520 mg of the sensitizing dye of the structure shown below was added.

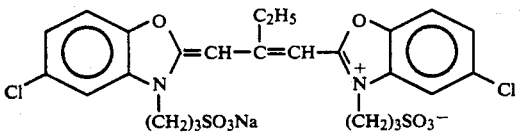

The emulsion obtained was such that 99.5% of the total projected area of all the grains was accounted for by grains of which the aspect ratio was at least 3, and the average projected area diameter of all the grains of aspect ratio of at least 2 was 1.48 μm, the standard deviation was 25.6%, the average thickness of the grains was 0.195 μm, the aspect ratio was 7.6 and the total iodine content was 3.2 mol. % with respect to the total amount of silver.

Preparation of Emulsion Coating Liquid

The components indicated below were added in the amounts indicated below per mol of silver halide to the emulsion described above to provide a coating liquid.

| | |
|---|---|
| Polymer Latex (poly(ethyl acrylate/methacrylic acid): copolymerization ratio 97/3 (by mol)) | 25.0 grams |
| Film Hardening Agent (1,2-bis(vinylsulfonylacetamido)ethane) | 3.0 grams |
| 2,6-bis(Hydroxyamino)-4-diethylamino-1,3,5-triazine | 80 mg |
| Poly(sodium acrylate) (average molecular weight 41,000) | 4.0 grams |
| Poly(potassium styrenesulfonate) average molecular weight 600,000) | 1.0 gram |
| Polyacrylamide (average molecular | 24 grams |

-continued

| | |
|---|---|
| weight 45,000) | |

Preparation of Support

A base on which a subbing layer of the coated weights indicated below had been provided on both sides of a poly(ethylene terephthalate) base of a thickness of 175 μm and which had been dyed blue was prepared.

| | |
|---|---|
| * Gelatin | 84 mg/m² |
| * Polymer indicated below | 60 mg/m² |
| * Dye indicated below | 17 mg/m² |

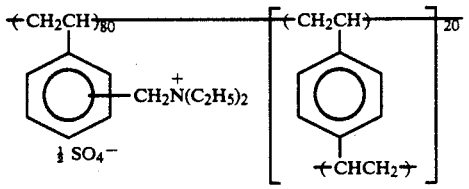

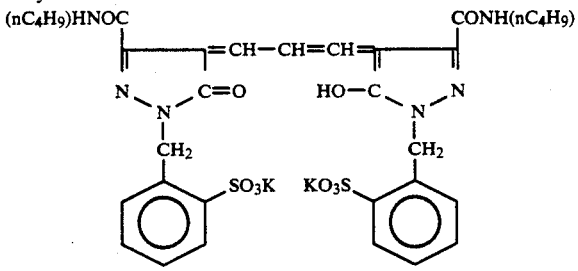

Preparation of Photographic Material

The above-described coating liquid was coated onto both sides of the above-described support at the same time as the surface protective layer coating liquid of the composition indicated below. The coated weight of silver was 1.85 g/m² per side. The surface protective layer was prepared such that the components were coated in the amounts indicated below.

Surface Protective Layer

| | |
|---|---|
| * Gelatin | 1.15 g/m² |
| * Polyacrylamide (average molecular weight 45,000) | 0.25 g/m² |
| * Poly(sodium acrylate) (average molecular weight 400,000) | 0.02 g/m² |
| * p-tert-Octylphenoxydiglycerylbutylsulfone compound, sodium salt | 0.02 g/m² |
| * Polyoxyethylene (degree of polymerization: 10) cetyl ether | 0.035 g/m² |
| * Polyoxyethylene (degree of polymerization: 10)-polyoxyglyceryl degree of polymerization: 3) p-octylphenoxy ether | 0.01 g/m² |
| * 4-Hydroxy-6-methyl-1,3,3a,7-tetraazaindene | 0.0155 g/m² |
| * 2-Chlorohydroquinone | 0.154 g/m² |
| * $C_8F_{17}SO_3K$ | 0.003 g/m² |
| * $C_8F_{17}SO_2N(C_3H_7)(CH_2-CH_2O)_4(CH_2)_4SO_3Na$ | 0.001 g/m² |

-continued

| | |
|---|---|
| * $C_8F_{17}SO_2N(C_3H_7)(CH_2CH_2O)_{15}H$ | 0.003 g/m² |
| * Poly(methyl methacrylate) (average particle size 3.5 μm) | 0.025 g/m² |
| * Poly(methyl methacrylate/methacrylic acid) (copolymerization ratio 7:3 (by mol), average particle size 2.5 μm) | 0.020 g/m² |

A photosensitive material where the degree of swelling of the coated film was 230% was prepared in this way. Furthermore, a photosensitive material where the degree of swelling of the coated film was 180% was prepared in the same way except that the amount of hardening agent, 1,2-bis(vinylsulfonylacetamido)ethane, added to the emulsion layer was changed to 4.0 grams per mol of silver halide.

Development Processing

Preparation of Concentrates

Developer

Part A

| | |
|---|---|
| Potassium hydroxide | 330 grams |
| Potassium sulfite | 630 grams |
| Sodium sulfite | 240 grams |
| Potassium carbonate | 90 grams |
| Boric acid | 45 grams |
| Diethylene glycol | 180 grams |
| Diethylenetriaminepentaacetic acid | 30 grams |
| 3,3'-Dithiobishydrocinnamio acid | 3 grams |
| 5-Methylbenzotriazole | 0.025 gram |
| Hydroquinone | 450 grams |
| Potassium bromide | 15 grams |
| Water to make | 4125 ml |

Part B

| | |
|---|---|
| Triethylene glycol | 525 grams |
| Acetic acid (glacial) | 102.6 grams |
| 5-Nitroindazole | 3.75 grams |
| 1-Phenyl-3-pyrazolidone | 34.5 grams |
| Water to make | 750 ml |

Part C

| | |
|---|---|
| Glutaraldehyde (50 wt/wt % aq. soln.) | 150 grams or 0 |
| Potassium metabisulfite | 150 grams |
| Water to make | 750 ml |

Fixer 1 (Two Reagent Type)

Part A

| | |
|---|---|
| Ammonium thiosulfate (70 wt/vol % aq. soln.) | 200 ml |
| Disodium ethylenediaminetetraacetate dihydrate | 0.03 gram |
| Sodium thiosulfate pentahydrate | 10 grams |
| Sodium sulfite | 15 grams |
| Boric acid | 4 grams |
| 1-(N,N-Dimethylamino)ethyl-5-mercapto-tetrazole | 1 gram |
| Tartaric acid | 3.2 grams |
| Acetic acid (glacial) | 13.5 grams |
| Sodium hydroxide | 7 grams |
| Water to make | 300 ml |
| pH | 5.5 |

Part B

| | |
|---|---|
| Sulfuric acid (36N) | 3.9 grams |
| Aluminum sulfate | 10 grams |
| Water to make | 50 ml |
| pH | 1 or less |

Fixer 2 (Single Reagent Type)

| | |
|---|---|
| Ammonium thiosulfate (70 wt/vol % aq. soln.) | 200 ml |
| Disodium ethylenediaminetetraacetate dihydrate | 0.03 gram |
| Sodium thiosulfate pentahydrate | 10 grams |
| Sodium sulfite | 15 grams |
| Boric acid | 4 grams |
| 1-(N,N-Dimethylamino)ethyl-5-mercapto-tetrazole | 1 gram |
| Tartaric acid | 3.2 grams |
| Acetic acid (glacial) | 13.5 grams |
| Sodium hydroxide | 5 grams |
| Sulfuric acid (36N) | 3.9 grams |
| Aluminum sulfate | 10 grams |
| Water to make | 400 ml |
| pH | 4.65 |

Fixer 3 (Single Reagent Type)

The composition (pH 4.65) was the same as Fixer 2 except that the amount of acetic acid (glacial) in Fixer 2 was changed to 31.5 grams and that the amount of sodium hydroxide was changed to 11 grams.

Preparation of Processing Baths

Each part of the above-described developer concentrate was packed into a polyethylene container. The containers for Parts A, B and C were connected together as one.

Furthermore, the above-described fixer concentrate was also packed into polyethylene containers. Fixer 1 was such that the containers for Parts A and B were connected together as a single container.

These developers and fixers were supplied using a metering pump, in the automatic processor, to the development tank and the fixer tank of the automatic processor in the proportions indicated below.

| | |
|---|---|
| Developer | |
| Part A | 55 ml |
| Part B | 10 ml |
| Part C | 10 ml |
| Water | 125 ml |
| pH | 10.50 |
| Fixer 1 | |
| Part A | 60 ml |
| Part B | 10 ml |
| Water | 130 ml |
| pH | 4.25 |
| Fixer 2 or Fixer 3 | |
| Concentrate | 80 ml |
| Water | 120 ml |
| pH | 4.65 |

Tap water was supplied to the water washing tank and 50 grams of a slow silver releasing agent (a trade name, "Biosure SG", made by Kinki Pipe Giken Co., Ltd.) which contained 0.5 wt. % of $Ag_2O$ in a soluble glass comprised of $Na_2O/B_2O_5/SiO_2$ which was contained in four bags made of non-woven fabric was left on the floor of the tank.

Structure of Automatic Processor

Although an automatic processor of the structure shown below was used in this example, automatic processors as disclosed in, for example, European Patents 308,212A and 330,401A can also be used in this invention.

| | Tank Capacity | Processing Temp. | Processing Path Length | Processing Time (1) | Processing Time (2) |
|---|---|---|---|---|---|
| Development | 15 liters | 35° C. | 613 mm | 13 seconds | 24.5 seconds |
| | | (Liquid Surface Area and Tank Capacity Ratio = 35 $cm^2$/liter) | | | |
| Fixing | 15 liters | 32° C. | 541 mm | 11.7 seconds | 21.6 seconds |
| Water Wash | 13 liters | 17° C. Running Water | 305 mm | 5.7 seconds | 10.5 seconds |
| Squeeze | | | | 6.6 seconds | 12.2 seconds |
| Drying | | 58° C. | 368 mm | 8.0 seconds | 14.7 seconds |
| Total | | | 1827 mm | 45.3 seconds | 83.6 seconds |

Processing

The above-described photosensitive materials were subjected to an X-ray exposure and then developed and processed using the automatic processor described above and the processing baths which had been mixed in the proportions indicated above while replenishing the developer at a rate of 40 ml per quarter plate size (10×12 inches) sheet and replenishing the fixer as indicated in Table 1 below.

The washing water was supplied at a flow rate of 10 liters per minute by opening an electromagnetic valve in synchronization with the time at which the photosensitive material was being processed (about 1 liter per quarter plate size sheet), and the electromagnetic valve was opened automatically on completion of operation at the end of the day and the water in the tank was all removed.

Run processing was carried out in this way until the developer and fixer attained the running equilibrium compositions and the performance of the processed photosensitive material was evaluated after attaining running equilibrium conditions.

Performance Evaluation

Residual Thiosulfate

This was evaluated by measuring the yellowing density using the silver sulfide method as described in ISO417-1977.

Residual Coloration

The transmission optical density (green light) of the unexposed area of the photosensitive material after processing was measured.

Fixer Odor

The odor of fixer with the running equilibrium composition was evaluated at two stages by sensory investigation.

O: Essentially no odor at all was observed.

X: There was an unpleasant odor when air was inhaled close to the liquid.

Roller Marks

The samples were exposed to provide a density of about 1.0 and unevenness due to the transporting rollers of the image after processing was evaluated. O indicates that there was essentially no unevenness, Δ indicates that there was some slight unevenness and X indicates that clear unevenness was observed.

The results obtained are shown in Table 1 below.

TABLE 1

| Experiment No. | Degree of Swelling of Photosensitive Material (%) | Glutaraldehyde Present, Yes or No | Processing Time | Fixer | Fixer Replenishment Rate* | pH of Fixer at Running Equilibrium | Amount of Residual Thiosulfate | Residual Coloration | Fixer Odor | Roller Marks | Remarks |
|---|---|---|---|---|---|---|---|---|---|---|---|
| 1 | 230 | No | 83.6 Seconds | ① | 60 | 4.48 | 0.23 | 0.17 | X | X | Comparative Example |
| 2 | " | Yes | 83.6 Seconds | ① | " | 4.46 | 0.06 | 0.14 | X | ○ | Comparative Example |
| 3 | " | No | 83.6 Seconds | ② | " | 4.88 | 0.14 | 0.16 | ○ | X | Comparative Example |
| 4 | " | Yes | 83.6 Seconds | ② | " | 4.86 | 0.03 | 0.12 | ○ | ○ | This Invention |
| 5 | " | No | 45.3 Seconds | ① | 60 | 4.49 | 0.28 | 0.21 | X | X | Comparative Example |
| 6 | " | Yes | 45.3 Seconds | ① | " | 4.48 | 0.08 | 0.16 | X | ○ | Comparative Example |
| 7 | " | No | 45.3 Seconds | ③ | " | 4.78 | 0.20 | 0.17 | ○ | X | Comparative Example |
| 8 | " | Yes | 45.3 Seconds | ③ | " | 4.75 | 0.04 | 0.13 | ○ | ○ | This Invention |
| 9 | " | No | 45.3 Seconds | ③ | " | 4.85 | 0.35 | 0.19 | ○ | X | Comparative Example |
| 10 | " | Yes | 45.3 | ③ | " | 4.83 | 0.07 | 0.13 | ○ | ○ | This |

TABLE 1-continued

| Experiment No. | Degree of Swelling of Photosensitive Material (%) | Glutaraldehyde Present, Yes or No | Processing Time | Fixer | Fixer Replenishment Rate* | pH of Fixer at Running Equilibrium | Amount of Residual Thiosulfate | Residual Coloration | Fixer Odor | Roller Marks | Remarks |
|---|---|---|---|---|---|---|---|---|---|---|---|
| 11 | 180 | No | Seconds 45.3 | ③ | " | 4.83 | 0.38 | 0.23 | X | Δ | Invention Comparative Example |
| 12 | " | Yes | Seconds 45.3 Seconds | ③ | " | 4.81 | 0.12 | 0.14 | ○ | ○ | This Invention |

*ml per quarter plate size sheet)

It is clear from the results in Table 1 above that residual thiosulfate and residual coloration are reduced by a combination of the presence of glutaraldehyde in the developer and a fixer running equilibrium pH of at least 4.6, and that good photographic processing with no problems with fixer odor and no roller marks can be achieved in this way. The effect due to this invention is clearly pronounced when the fixer replenishment rate is low and rapid processing is being used.

EXAMPLE 2

Mixed processing of about 150 sheets per day of X-ray photosensitive material (Super HR-S, Super HR-A and Super HR-L, made by the Fuji Photo Film Co., Ltd.) was carried out continuously for three months using the automatic processor described in Example 1 (processing time: 45.3 seconds) with the glutaraldehyde-containing developer of Example 1 (replenishment rate: 25 ml per quarter plate size sheet) and Fixer 1 (replenishment rate: 25 ml per quarter plate size sheet). Processing was carried out with no problems on residual thiosulfate, residual coloration, fixer odor or roller marks.

While the invention has been described in detail and with reference to specific embodiments thereof, it will be apparent to one skilled in the art that various changes and modifications can be made therein without departing from the spirit and scope thereof.

What is claimed is:

1. A method for development processing of a silver halide photosensitive material using an automatic processor including at least the functions of development, fixing, washing and drying, which comprises (1) using an alkaline developer containing a dialdehyde film hardening agent, and (2) carrying out the processing under conditions such that the running equilibrium pH of the fixer is from 4.6 to 5, wherein the fixer comprises a water-soluble aluminum salt and a pH buffer in an amount of at least 0.5 mol/liter, said pH buffer comprising an organic acid, the replenisher concentrate of the fixer is a single reagent, and the replenishment rate of the fixer is 0.5 liters or less per square meter of the photosensitive material.

2. The method for development processing of a silver halide photosensitive material of claim 1, wherein the running equilibrium pH of the fixer is from 4.7 to 4.9.

3. The method for development processing of a silver halide photosensitive material of claim 1, wherein the processing time from the beginning of development to the completion of drying is 90 seconds or less.

4. The method for development processing of a silver halide photosensitive material of claim 1, wherein the dialdehyde film hardening agent is selected from the group consisting of glutaraldehyde, α-methylglutaraldehyde, β-methylglutaraldehyde, maleic dialdehyde, succinic dialdehyde, methoxysuccinic dialdehyde, methylsuccinic dialdehyde, α-methoxy-β-butoxyglutaraldehyde, α-n-butoxysuccinic dialdehyde, α,α-dimethoxysuccinic dialdehyde, β-isopropylsuccinic dialdehyde, α,α-diethylsuccinic dialdehyde, butylmaleic dialdehyde and the bisulfite addition compounds of these dialdehydes.

5. The method for development processing of a silver halide photosensitive material of claim 1, wherein the amount of the dialdehyde film hardening agent in the developer is from 1 to 95 grams per liter of developer.

6. The method for development processing of a silver halide photosensitive material of claim 1, wherein the water-soluble aluminum salt is selected from the group consisting of aluminum chloride, aluminum sulfate and potassium alum.

7. The method for development processing of a silver halide photosensitive material of claim 1, wherein the water-soluble aluminum salt is present in amount of from 0.01 to 0.2 mol/liter.

8. The method for development processing of a silver halide photosensitive material of claim 7, wherein the amount is from 0.03 to 0.08 mol/liter.

9. The method for development processing of a silver halide photosensitive material of claim 1, wherein the fixer further comprises thiosulfate.

10. The method for development processing of a silver halide photosensitive material of claim 9, wherein thiosulfate is present in an amount of from about 0.1 to about 6.0 mol/liter.

11. The method for development processing of a silver halide photosensitive material of claim 1, wherein the water-soluble aluminum salt is present in an amount of 0.01 to 0.2 mol/liter.

12. The method for development processing of a silver halide photosensitive material of claim 11, wherein the amount is 0.03 to 0.08.

* * * * *